US010907420B1

(12) United States Patent
Ford

(10) Patent No.: US 10,907,420 B1
(45) Date of Patent: Feb. 2, 2021

(54) ROLLER COUPLING APPARATUS AND METHOD THEREFOR

(71) Applicant: Michael Brent Ford, St. George, UT (US)

(72) Inventor: Michael Brent Ford, St. George, UT (US)

( * ) Notice: Subject to any disclaimer, the term of this patent is extended or adjusted under 35 U.S.C. 154(b) by 0 days.

(21) Appl. No.: 16/520,046

(22) Filed: Jul. 23, 2019

(51) Int. Cl.
*E21B 17/10* (2006.01)
*E21B 43/12* (2006.01)
*E21B 17/042* (2006.01)

(52) U.S. Cl.
CPC ..... *E21B 17/1057* (2013.01); *E21B 17/042* (2013.01); *E21B 43/126* (2013.01)

(58) Field of Classification Search
CPC ..... E21B 17/1057; E21B 17/10712; E21B 17/1071; E21B 23/001
See application file for complete search history.

(56) References Cited

U.S. PATENT DOCUMENTS 712,487 A * 11/1902 Black ..... E21B 17/1057 166/241.3
713,723 A * 11/1902 Vinzent ..... E21B 17/1057 166/241.3
1,281,756 A * 10/1918 Black ..... E21B 17/1057 166/241.3
1,788,363 A * 1/1931 Brooks ..... E21B 17/1057 403/9
2,046,348 A * 7/1936 Simmons ..... E21B 17/1071 166/241.2
2,198,720 A * 4/1940 Edgecomb ..... E21B 17/1057 166/241.3
3,545,825 A * 12/1970 Hamilton ..... E21B 17/1057 175/325.4
3,995,479 A * 12/1976 Chapman, III ..... E21B 17/1042 73/152.47
4,620,802 A * 11/1986 Harrel ..... E21B 17/1057 166/241.3

(Continued)

FOREIGN PATENT DOCUMENTS

CA 2387881 A1 * 5/2001 ..... E21B 17/1057
WO WO-2020009692 A1 * 1/2020 ..... E21B 23/14

OTHER PUBLICATIONS

UPC Global, "Wheeled Rod Guides (R)," https://www.upcoglobal.com/images/brochures/Brochure_OFI_v2.pdf, accessed Jul. 8, 2019, 6 pages.

*Primary Examiner* — Jennifer H Gay
(74) *Attorney, Agent, or Firm* — Weiss & Moy, P.C.; Karen J. S. Fouts

(57) ABSTRACT

A roller coupling apparatus for securing rods and other threaded components together in a pumping system. The roller coupling apparatus can include a body with a plurality of radially-positioned wheels rotatably coupled to the body. The arrangement of the wheels can uniformly spread the rod load within the interior diameter of the tubing. In operation, the wheels contact and roll along the interior diameter of the tubing, preventing surface-to-surface wear of the coupling body exterior and tubing interior, thereby prolonging coupling and tubing life. In one embodiment, the wheels can include wear grooves that can indicate wear areas in the wellbore. Multiple apparatuses can be utilized to form rod strings of various lengths.

14 Claims, 5 Drawing Sheets

(56) References Cited

U.S. PATENT DOCUMENTS 4,621,690 A * 11/1986 Klyne ..... E21B 17/1057 166/176
4,624,313 A * 11/1986 Coshow ..... E21B 17/1057 166/241.5
4,714,110 A 12/1987 Dysarz
4,779,678 A * 10/1988 White ..... E21B 17/1057 166/241.3
4,793,412 A * 12/1988 Rivas ..... E21B 17/1057 166/241.3
4,871,020 A * 10/1989 Rivas ..... E21B 17/1057 166/241.3
4,911,239 A * 3/1990 Winckler ..... E21B 17/1057 166/302
4,913,230 A * 4/1990 Rivas ..... E21B 17/1057 166/241.3
4,919,205 A * 4/1990 Dollison ..... E21B 17/1057 166/241.3
6,684,965 B1 * 2/2004 Bakke ..... E21B 17/1057 175/99
6,830,103 B2 * 12/2004 Bowles ..... E21B 17/1057 166/241.3
6,968,904 B2 * 11/2005 Bakke ..... E21B 17/1057 166/382
9,157,287 B2 * 10/2015 Slocum ..... E21B 23/00
9,790,748 B2 * 10/2017 Hradecky ..... E21B 17/1057
2004/0154809 A1 * 8/2004 Bakke ..... E21B 17/1057 166/382
2013/0319684 A1 * 12/2013 Moellendick ..... E21B 17/1057 166/378
2014/0174760 A1 * 6/2014 Slocum ..... E21B 4/18 166/381
2014/0299376 A1 * 10/2014 Bertelsen ..... E21B 19/168 175/24
2015/0027729 A1 * 1/2015 Hradecky ..... E21B 17/1057 166/378
2015/0361731 A1 * 12/2015 Wood ..... E21B 17/1071 166/381
2016/0355059 A1 * 12/2016 Katahira ..... B60C 7/00
2018/0282137 A1 * 10/2018 Kaybidge ..... F16C 25/06

* cited by examiner

ROLLER COUPLING APPARATUS AND METHOD THEREFOR

FIELD OF THE INVENTION

The present invention generally relates to oil pumps and couplings used therein and, more specifically, to a roller coupling apparatus and related method therefor.

BACKGROUND OF THE INVENTION

In general terms, an oil well pumping system begins with an above-ground pumping unit, which creates the up and down pumping action that moves the oil (or other substance being pumped) out of the ground and into a flow line, from which the oil is taken to a storage tank or other such structure.

Below ground, a shaft or "wellbore" is lined with piping known as "casing." Into the casing is inserted piping known as "tubing." A string of sucker rods is inserted into the tubing. The string of sucker rods typically includes multiple individual sucker rods, which are typically 25-28 feet in length each. In addition, the rod string can include pony rods (also known as shooter rods, pups, and rod subs), which are sucker rods that are less than 25 feet in length. Pony rods can be of different lengths, such as two, four, six, or eight feet in length. The individual sucker rods are joined together with couplings to form the sucker rod string. According to American Petroleum Institute (API) specifications, such couplings are 4.5 to 5 inches in length. Standard couplings may typically be 4-6 inches in length. The sucker rod string can be up to or more than one mile in length and is ultimately, indirectly coupled at its north end to the above-ground pumping unit. The string of sucker rods is coupled at its south end indirectly to the subsurface oil pump itself, which is also located within the tubing, which is sealed at its base to the tubing. The sucker rod string couples to the oil pump at a coupling known as a 3-wing cage. A sinker bar, which is heavily-weighted to help maintain the tension in the sucker rod string particularly on the downstroke, can be positioned directly above the subsurface oil pump.

The subsurface oil pump has a number of basic components, including a barrel and a plunger. The plunger operates within the barrel, and the barrel, in turn, is positioned within the tubing. The north end of the plunger is typically connected to a valve rod or hollow valve rod, which moves up and down to actuate the pump plunger. The valve rod or hollow valve rod typically passes through a valve rod guide.

Beginning at the south end, subsurface oil pumps generally include a standing valve, which has a ball therein, the purpose of which is to regulate the passage of oil (or other substance being pumped) from downhole into the pump, allowing the pumped matter to be moved northward out of the system and into the flow line, while preventing the pumped matter from dropping back southward into the hole. Oil is permitted to pass through the standing valve and into the pump by the movement of the ball off of its seat, and oil is prevented from dropping back into the hole by the seating of the ball.

North of the standing valve, coupled to the sucker rod, is a traveling valve. The purpose of a conventional traveling valve is to regulate the passage of oil from within the pump northward in the direction of the flow line, while preventing the pumped oil from slipping back down in the direction of the standing valve and hole.

In use, oil is pumped from a hole through a series of "downstrokes" and "upstrokes" of the oil pump, wherein these motions are imparted by the above-ground pumping unit. During the upstroke, formation pressure causes the ball in the standing valve to move upward, allowing the oil to pass through the standing valve and into the barrel of the oil pump. This oil will be held in place between the standing valve and the traveling valve. In the conventional traveling valve, the ball is located in the seated position. It is held there by the pressure from the oil that has been previously pumped. The oil located above the traveling valve is moved northward in the direction of the 3-wing cage at the end of the oil pump.

During the downstroke, the ball in the conventional traveling valve unseats, permitting the oil that has passed through the standing valve to pass therethrough. Also during the downstroke, the ball in the standing valve seats, preventing the pumped oil from slipping back down into the hole.

The process repeats itself again and again, with oil essentially being moved in stages from the hole, to above the standing valve and in the oil pump, to above the traveling valve and out of the oil pump. As the oil pump fills, the oil passes through the 3-wing cage and into the tubing. As the tubing is filled, the oil passes into the flow line, from which the oil is taken to a storage tank or other such structure.

Unlike typical wellbores of the past, which are typically drilled in relatively straight vertical lines, a current drilling trend is for wellbores to be drilled vertically in part and then horizontally in part, resulting in wellbores that have some curvature or "deviation." Such wells may commonly be referred to as "deviated" wells. When drilling deviated wells, drillers typically drill vertically for some distance (e.g. one mile), through the upper zone and down to the bedrock, and then transition to drilling horizontally. One advantage to drilling wellbores in this configuration is that the horizontal area of the well typically has many more perforations in the casing, which allows for more well fluid to enter the wellbore than with typical vertical casing wells. This, in turn, allows for more well fluid to be pumped to the surface. It should be understood that while conventional wells are typically drilled vertically, conventional wells can also have some moderate curvature or deviation in the wellbore.

Horizontal wells may typically be drilled at an angle of roughly ten to twelve degrees over roughly 1000 feet to allow for a gradual slope. This results in approximately one degree of deviation for every 100 feet. A problem that occurs when drilling such wells, particularly when they are drilled relatively fast, is that the wells are not drilled perfectly, resulting in crooked wellbores. Such wells may have many slight to extreme deviations in the drill hole, which would create a non-linear configuration. When the deviated well is completed to depth, the drill pattern is positioned horizontally to drill. The pump, coupled to the sucker rod string, then must be lowered from the surface through all of the deviations of the wellbore down to the horizontal section of the well where it would be placed in service.

There are a number of problems that are regularly encountered during oil pumping operations. Oil that is pumped from the ground is generally impure, and includes water, gas, and solid impurities such as sand and other debris. The presence of solids can cause major damage to the pump components, thus reducing the run cycle of the pump, reducing revenue to the operator, and increasing expenses. For example, during pumping operations, scale, paraffin, or other solids buildup can accumulate in various areas of the tubing. This can create a very narrow tolerance between the pumping system's various subsurface components (including, for example, rods, rod couplings, and sinker bars) and the tubing which, in turn, can cause wear and damage to these subsurface components and tubing during pumping operations, especially when they are dragged across the interior diameter surface of the tubing. Further, particularly where deviations are present (whether in conventional or horizontal wells), the rod couplings can make contact with the tubing, also causing wear and damage to the couplings and tubing during pumping operations. In such situations, the rod couplings and tubing must then be repaired or replaced, which is both time consuming and expensive and, further, can result in loss of revenue to the well operators while the well is non-operational.

One solution to address these problems has been to provide wheeled couplings/rod guides. However, presently known wheeled couplings/rod guides suffer from several shortcomings in various areas of the design. For example, such wheeled couplings/rod guides are typically around 28 inches in length, which falls outside of the API specification range for rod couplings. Such wheeled couplings/rod guides require manual installation with hand wrenches or other hand tools. This method of installation is time consuming and can result in inconsistent torque application during coupling installation. This can cause loosening of the couplings and rod parts during pumping operations, leading to coupling failure and expensive well downtime. As a further example, the wheels of presently known wheeled couplings/rod guides are typically fitted through openings in the body of the coupling/rod guide and centered vertically in the body, such that portions of each wheel protrude from opposing sides of the body. This configuration can be problematic. For example, in the event that the wheel encounters a high spot in the tubing due to scale or paraffin or other solids buildup, the wheel will seize and drag through the high spot, causing damage to the wheel by flattening its protruding portions.

The present invention addresses these problems encountered in prior art pumping systems, and provides other, related, advantages.

SUMMARY

In accordance with one embodiment of the present invention, a roller coupling apparatus is disclosed. The roller coupling apparatus comprises, in combination: a body having a threaded north end and a threaded south end; and a plurality of wheels rotatably coupled to the body; wherein the wheels are positioned radially around the body; and wherein the wheels are spaced-apart equidistantly from each other.

In accordance with another embodiment of the present invention, a roller coupling apparatus is disclosed. The roller coupling apparatus comprises, in combination: a body comprising: a threaded north end; a threaded south end; a plurality of wheel wells positioned between the north end and the south end; and a plurality of aligned pairs of openings; a plurality of wheels rotatably coupled to the body, a plurality of inserts, each insert having an opening configured to receive an axle, and wherein each insert is configured to be positioned in an opening in one of the plurality of wheels; a plurality of axles, wherein each axle is configured to be positioned through one of the plurality of aligned pairs of openings in the body and in one of the plurality of inserts; wherein each wheel well of the plurality of wheel wells is configured to receive one of the plurality of wheels; wherein the wheels are positioned radially around the body; and wherein the wheels are spaced-apart equidistantly from each other.

In accordance with another embodiment of the present invention, a method for protecting pumping system components from wear during pumping operations is disclosed. The method comprises the steps of: providing a pumping unit; providing a roller coupling apparatus comprising, in combination: a body having a threaded north end and a threaded south end; and a plurality of wheels rotatably coupled to the body; wherein the wheels are positioned radially around the body; and wherein the wheels are spaced-apart equidistantly from each other, providing a first threaded component; providing a second threaded component; securing together the first and second threaded components by threadably coupling the north end of the roller coupling apparatus to a south end of the first threaded component and threadably coupling the south end of the roller coupling apparatus to a north end of the second threaded component to form an assembly; positioning the assembly within tubing of a wellbore; causing the assembly to move up with an upstroke of the pumping unit and down with a downstroke of the pumping unit; and during the movement with the upstroke and the downstroke, causing the wheels of the roller coupling apparatus to contact and roll along an interior diameter surface of the tubing.

BRIEF DESCRIPTION OF THE DRAWINGS

The present application is further detailed with respect to the following drawings. These figures are not intended to limit the scope of the present application, but rather, illustrate certain attributes thereof.

DETAILED DESCRIPTION OF THE INVENTION

Figure 1:
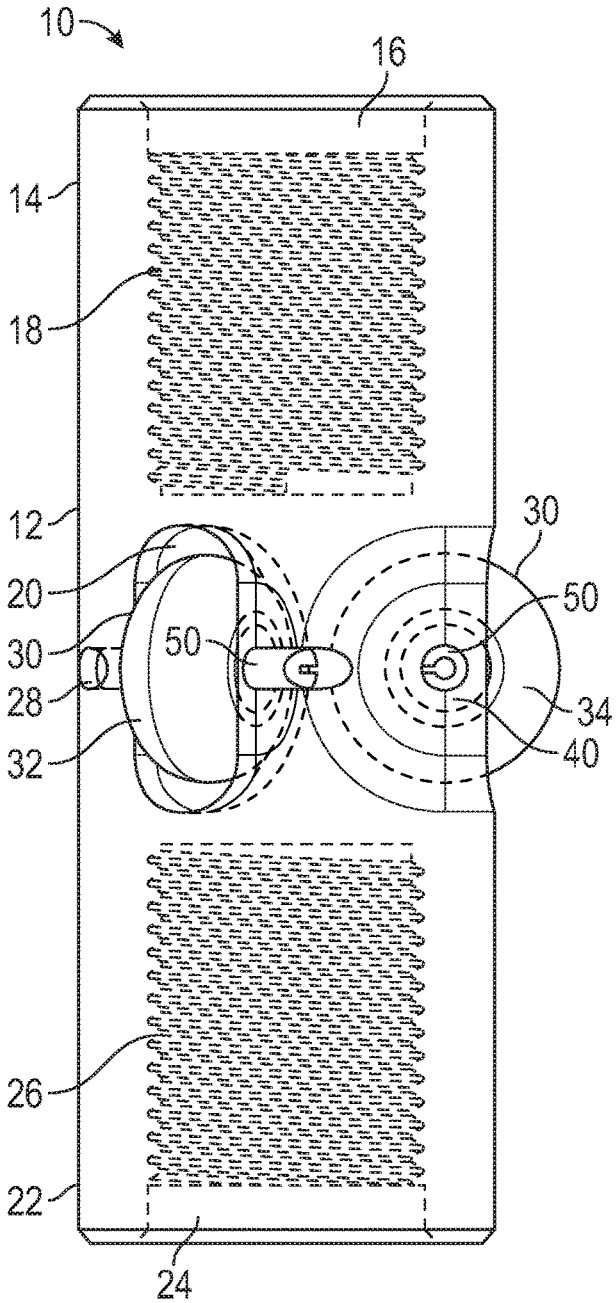
FIG. 1 is a side view of an embodiment of a roller coupling apparatus in accordance with one or more aspects of the present invention, with portions thereof shown in phantom.

The description set forth below in connection with the appended drawings is intended as a description of presently preferred embodiments of the disclosure and is not intended to represent the only forms in which the present disclosure may be constructed and/or utilized. The drawing figures are not necessarily drawn to scale and certain figures can be shown in exaggerated or generalized form in the interest of clarity and conciseness. The description sets forth the functions and the sequence of steps for constructing and operating the disclosure in connection with the illustrated embodiments. It is to be understood, however, that the same or equivalent functions and sequences may be accomplished by different embodiments that are also intended to be encompassed within the spirit and scope of this disclosure.

FIGS. 1-10, together, disclose embodiments of a roller coupling apparatus 10 of the present invention. The roller coupling apparatus 10 is adapted to be used with a pumping system, such as an oil pumping system, that is positioned within a pump barrel. The roller coupling apparatus 10 is configured to securely couple two various threaded components that are placed within the tubing, such as rods, including sucker rods and pony rods, and sinker bars. The roller coupling apparatus 10 provides rolling capability at the threaded connections and thereby prevents subsurface components such as couplings, rods, and sinker bars from being dragged across the interior diameter surface of the tubing during pumping operations, which would cause damage to both the subsurface components and tubing. Although the term "oil" is used herein, it should be understood that the roller coupling apparatus 10 of the present invention may be used in pumping systems that pump fluids other than oil, such as debris-containing water. In describing the structure of the roller coupling apparatus 10 and its operation, the terms "north" and "south" are utilized. The term "north" is intended to refer to that end of the pumping system that is more proximate the pumping unit, while the term "south" refers to that end of the system that is more distal the pumping unit, or "downhole."

Figure 2:
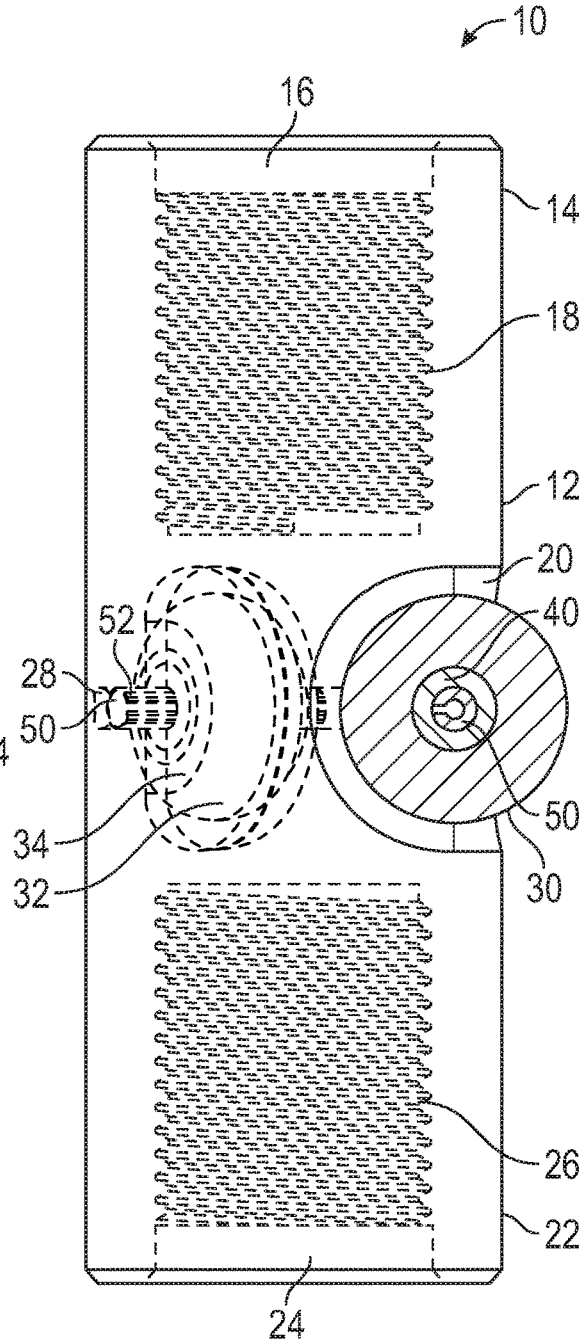
FIG. 2 is a side, cross-sectional view of the roller coupling apparatus of FIG. 1, with portions thereof shown in phantom.
Figure 3:
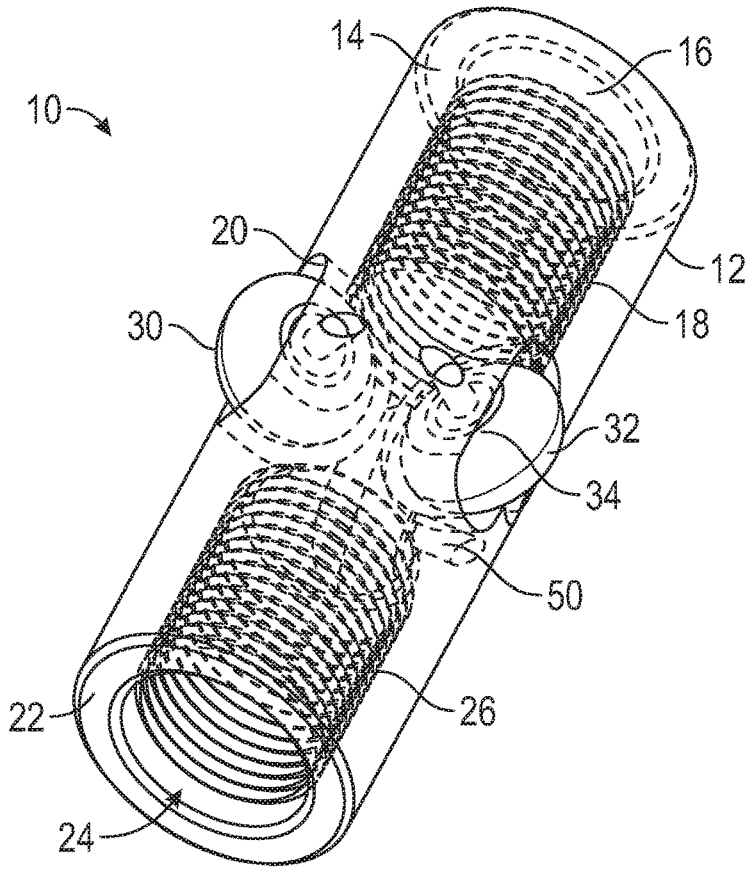
FIG. 3 is a bottom perspective view of the roller coupling apparatus of FIG. 1, with portions thereof shown in phantom.

Referring first to FIGS. 1-3, an embodiment of the roller coupling apparatus 10 of the present invention is shown. The roller coupling apparatus 10, which has a substantially cylindrical external configuration, can be divided into the following principal components: a body 12 and a plurality of rollers or wheels 30 (hereinafter wheels 30) which are rotatably coupled to the body 12.

Beginning at the top portion of FIGS. 1-3, the components of the roller coupling apparatus 10 will be described in further detail. In this embodiment, the body 12 comprises a north end 14 having an inlet 16, which is configured to receive a southern end of a rod (not shown). Inlet 16 includes a threaded region 18. Threaded region 18 is configured to permit the roller coupling apparatus 10 to be coupled to a southern end of a rod. As seen in this embodiment, threaded region 18 can originate southward of north end 14 and terminate northward of a plurality of wheel wells 20. While in this embodiment threaded region 18 is shown as comprising female threading, in order to correspond to male pin threading present on the ends of conventional rods, it should be understood that threaded region 18 may comprise either male or female threading, as long as it engages corresponding male or female threading present on the rod to which it may be coupled.

Figure 4:
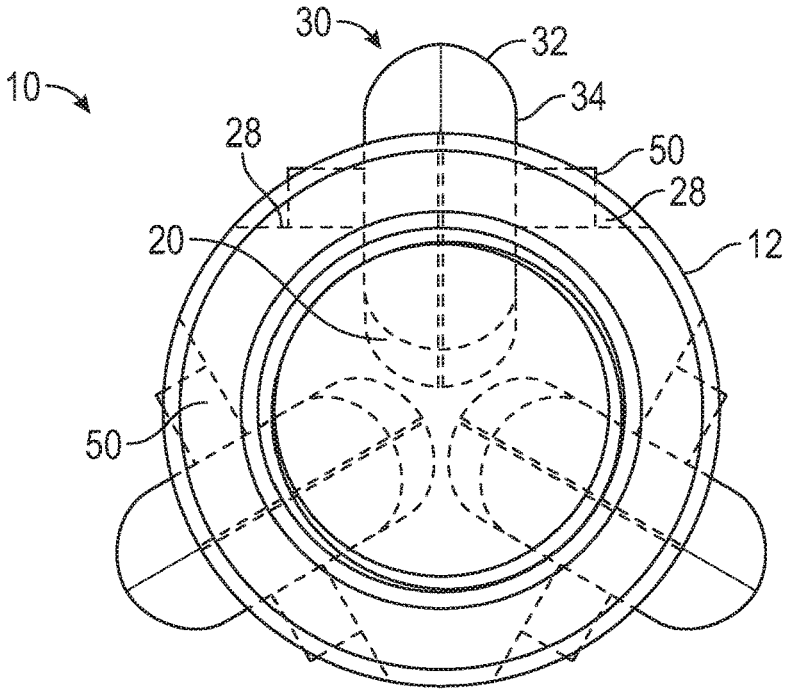
FIG. 4 is an end view of the roller coupling apparatus of FIG. 1, with portions thereof shown in phantom.

Continuing southward in the drawing figures, as seen in this embodiment, the body 12 further includes a plurality of wheel wells 20, each of which is configured to house one of a plurality of wheels 30, as described further herein. Each wheel well 20 can be substantially semi-circularly shaped and can comprise a concave wall configured to correspond to the shape of each wheel 30. With this configuration, a portion of each wheel 30 can be positioned within each wheel well 20. This configuration helps to protect the wheels 30 from damage that could otherwise be caused by the narrow tolerance between the roller coupling apparatus 10 exterior and tubing interior due to buildup of scale, paraffin or other solids, since the wheels 30 will continue to roll in such solids buildup areas. This is in contrast to presently known wheeled couplings/rod guides, in that the wheels of such couplings/rod guides can seize and become dragged through areas of the tubing having solids buildup, flattening the wheels. Each wheel well 20 can have an overall diameter that is greater than an exterior diameter of each wheel 30. In this way, each wheel 30 can be suspended when positioned in each wheel well 20 without contacting the interior surface of the wheel well 20. As best seen in FIG. 4, in this embodiment, the roller coupling apparatus 10 utilizes a set of three wheel wells 20 (corresponding to three wheels 30) that are positioned in the same horizontal plane. The wheel wells 20 are positioned radially around the body 12 and are spaced-apart equidistantly from each other. In this embodiment, the wheel wells 20 are spaced 120 degrees apart. While in this embodiment three wheel wells 20 are shown, it should be understood that more than three wheel wells 20 (corresponding to more than three wheels 30) may be provided as may be needed for particular well conditions and configurations and depending upon the dimensions of the body 12 of the roller coupling apparatus 10.

Referring now to FIG. 4, the body 12 further includes a plurality of aligned pairs of openings 28. Each opening 28 is configured to receive an end of an axle 50, to permit the wheels 30 to be coupled to the body 12, as described further herein. While in this embodiment three aligned pairs of openings 28 (corresponding to three wheels 30) are shown, it should be understood that more than three aligned pairs of openings 28 (corresponding to more than three wheels 30) may be provided as may be needed for particular well conditions and configurations and depending upon the dimensions of the body 12 of the roller coupling apparatus 10.

Referring again to FIGS. 1-3 and continuing with the bottom portion thereof, in this embodiment, the body 12 further comprises a south end 22 having an inlet 24, which is configured to receive a northern end of a rod (not shown). Similar to inlet 16, inlet 24 includes a threaded region 26. Threaded region 26 is configured to permit the roller coupling apparatus 10 to be coupled to a northern end of a rod or sinker bar. As seen in this embodiment, threaded region 26 can originate northward of south end 22 and terminate southward of wheel wells 20. While in this embodiment threaded region 26 is shown as comprising female threading, in order to correspond to male pin threading present on the ends of conventional rods and sinker bars, it should be understood that threaded region 26 may comprise either male or female threading, as long as it engages corresponding male or female threading present on the rod or sinker bar to which it may be coupled.

In one embodiment, the body 12 can be approximately five inches in length. However, it should be understood that the length of the body 12 may deviate from this dimension, as desired. For example, the roller coupling apparatus 10 could have a length longer than five inches, in order to accommodate additional sets of three wheels 30 each, as described further herein, or as may be required for heavier rod loads, severe deviation of the wellbore configuration, and the like. As another example, the roller coupling apparatus 10 could have a length slightly less than five inches.

Figure 5A:
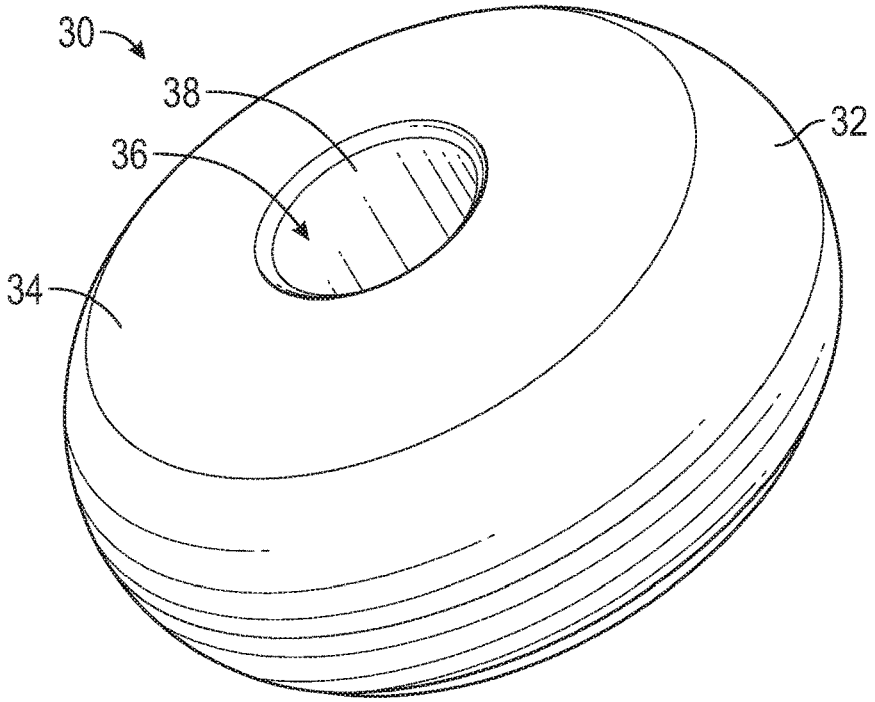
FIG. 5A is a perspective view of an illustrative wheel of the roller coupling apparatus of the present invention.

Referring now to FIGS. 1-5A, the wheel 30 of the roller coupling apparatus 10 will be discussed in further detail. As seen in this embodiment, wheel 30 includes an outer wall 32 flanked by sidewalls 34. Outer wall 32 can be substantially convex in shape. As best seen in FIG. 5A, each wheel 30 is provided with a central opening 36, defined by opening wall 38, which is configured to receive an insert 40. Wheel 30 can be fabricated from a variety of high-density materials suitable for downhole pumping applications including, by way of example only, various metals, such as stainless steel or alloys such as TOUGHMET alloys by Materion Corporation or high-density thermoplastics or high-density polymers. While in this embodiment three wheels 30 are provided in the roller coupling apparatus 10 (see FIG. 4), it should be understood that more than three wheels 30 may be provided as may be needed for particular well conditions and configurations and depending upon the dimensions of the body 12 of the roller coupling apparatus 10.

Figure 5B:
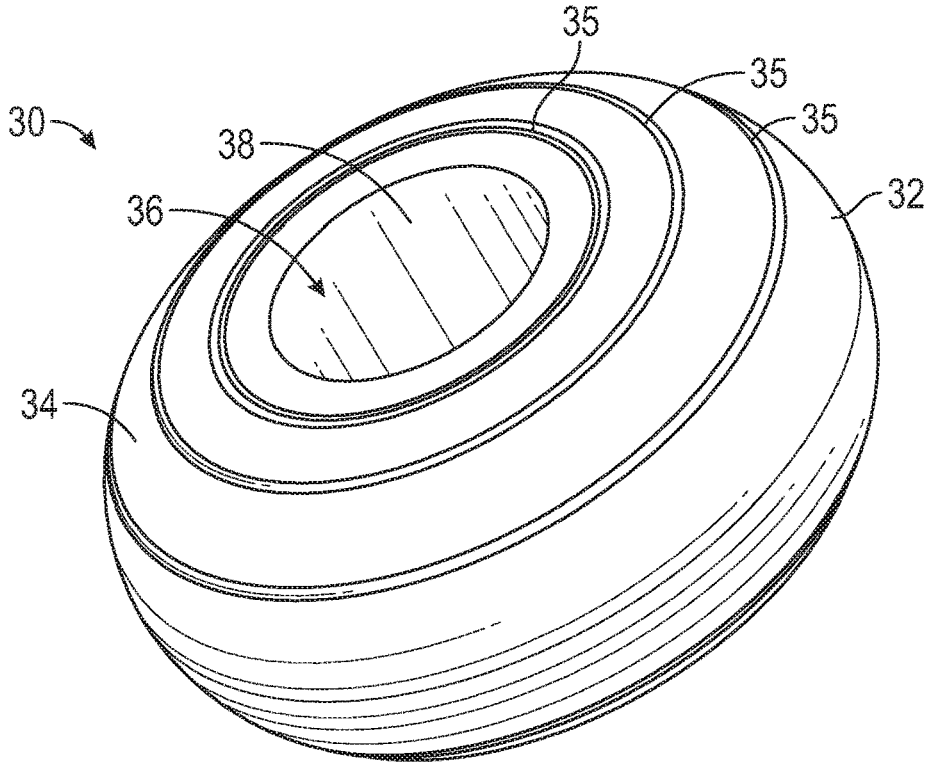
FIG. 5B is a perspective view of an illustrative wheel of the roller coupling apparatus of the present invention.
Figure 8:
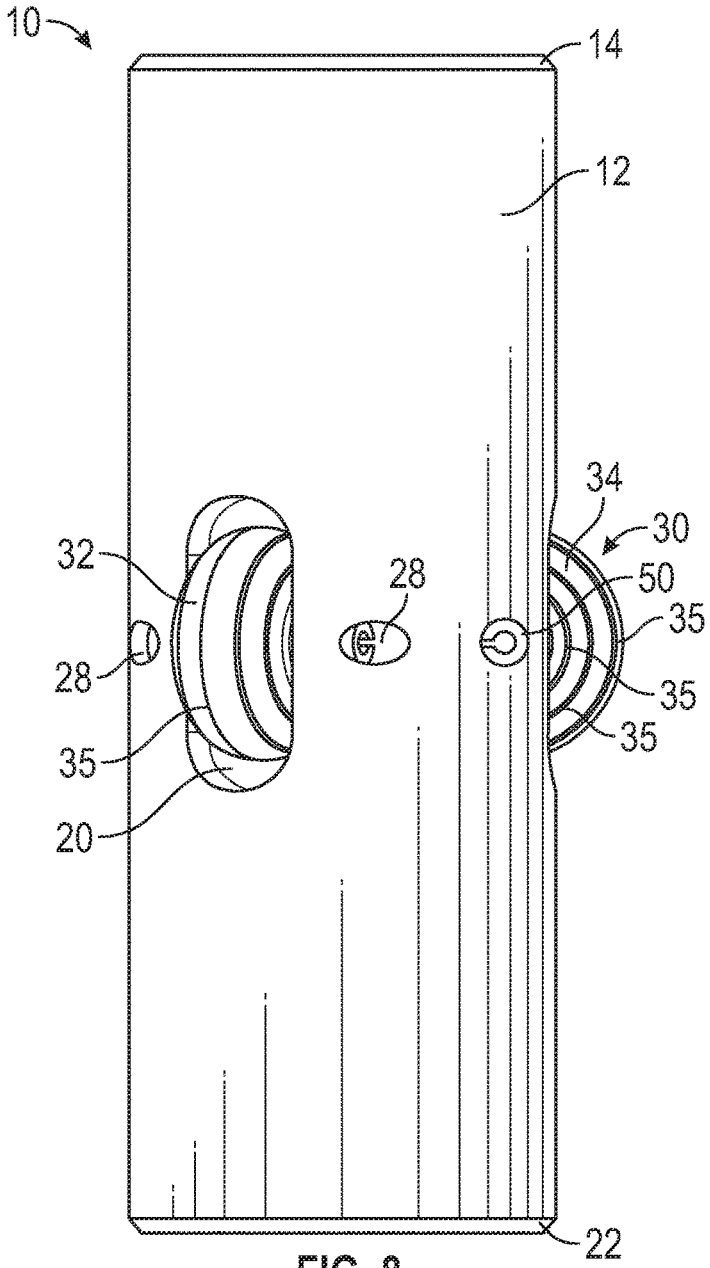
FIG. 8 is a side view of an embodiment of a roller coupling apparatus in accordance with one or more aspects of the present invention.

Referring now to FIGS. 5B and 8, in one embodiment, wheel 30 includes wear grooves 35. In one embodiment, wear grooves 35 can be concentric and spaced apart equidistantly from each other. In one embodiment, each groove 35 can have a depth ranging from approximately 0.0001 to 0.010 inch. However, it would be possible to vary the depth of grooves 35, as may be needed for particular well conditions and configurations. While in this embodiment seven grooves 35 are provided (with three grooves 35 on each sidewall 34 and one groove 35 on outer wall 32), it should be understood that more or fewer than seven grooves 35 may be provided as desired.

Figure 6:
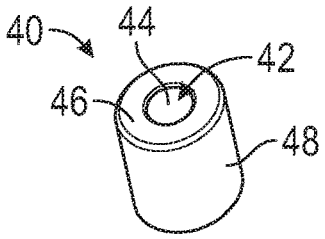
FIG. 6 is a perspective view of an illustrative insert of the roller coupling apparatus of the present invention.

Referring now to FIG. 6, the insert 40 of the roller coupling apparatus 10 will be discussed in further detail. As seen in this embodiment, insert 40 is generally a hollow cylinder in shape. Insert 40 includes a central opening 42 defined by opening wall 44, which is configured to receive an axle 50. Insert 40 can include side surfaces 46 and outer surface 48. Insert 40 can be fabricated from a variety of high-density materials suitable for downhole pumping applications including, by way of example only, various metals, such as stainless steel or alloys such as TOUGHMET alloys. While in this embodiment three inserts 40 are provided in the roller coupling apparatus 10 corresponding to three wheels 30 (see FIG. 4), it should be understood that more than three inserts 40 may be provided depending upon the number of wheels 30 utilized.

Figure 7:
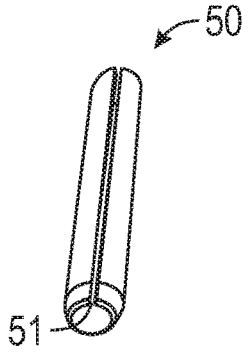
FIG. 7 is a perspective view of an illustrative axle of the roller coupling apparatus of the present invention.

Each wheel 30 is rotatably coupled to the body 12 by axle 50, which is inserted through aligned openings 28 and 42 in the body 12 and insert 40, respectively. Referring now to FIG. 7, the axle 50 of the roller coupling apparatus 10 will be discussed in further detail. As seen in this embodiment, axle 50 is generally cylindrical in shape. In one embodiment, axle 50 can be hollow and can include a slit 51 from end to end. When wheel 30 fitted with insert 40 is positioned in wheel well 20, axle 50 may then be positioned through a first opening 28 in body 12, opening 42 in insert 40, and a second opening 28 in body 12. When so positioned, each end of axle 50 may protrude outwardly from insert 40 into aligned pairs of openings 28 in the body 12, thereby securing each wheel 30 in position on the body 12. As seen in FIG. 4, in one embodiment, the ends of each axle 50 may further protrude slightly from an outer diameter of the body 12. Referring to FIG. 2, each axle 50 can further include a plurality of ridges 52, which may grip the opening wall 44 of insert 40, thereby securing axle 50 in place. Axle 50 can be fabricated from a variety of high-density materials suitable for downhole pumping applications including, by way of example only, various metals, such as stainless steel, carbon steel, or alloys such as TOUGHMET alloys. While in this embodiment three axles 50 are provided in the roller coupling apparatus 10 (see FIG. 4), it should be understood that more than three axles 50 may be provided depending upon the number of wheels 30 utilized.

As best seen in FIG. 4, in this embodiment, the roller coupling apparatus 10 utilizes a set of three wheels 30 that are positioned in the same horizontal plane. The wheels 30 are positioned radially around the body 12 and are spaced-apart equidistantly from each other. In this embodiment, the wheels 30 are spaced 120 degrees apart. This configuration spreads the rod load more uniformly within the interior diameter of the tubing. In this regard, this configuration allows for 360-degree load weight carrying of the rod to transfer to the wheels 30 which roll inside the tubing, thereby eliminating the surface-to-surface wear of the sucker rod coupling and tubing that can occur during pumping operations, especially in deviated areas of the wellbore. While in this embodiment three wheels 30 are provided in the roller coupling apparatus 10, it should be understood that more than three wheels 30 may be provided as may be needed for particular well conditions and configurations and depending upon the dimensions of the body 12 of the roller coupling apparatus 10. For example, where the body 12 has relatively larger dimensions, it may be desired to provide additional radially-positioned wheels 30. Further, while in this embodiment the wheels 30 are shown positioned inline vertically on the body 12, it should be understood that the wheels 30 can be positioned at various degrees from vertical on the body 12. Such a configuration allows for slight rod rotation during pumping operations which, in turn, allows for more even wear, helping to eliminate premature pumping operation failures related to rod and tubing wear issues.

Figure 9:
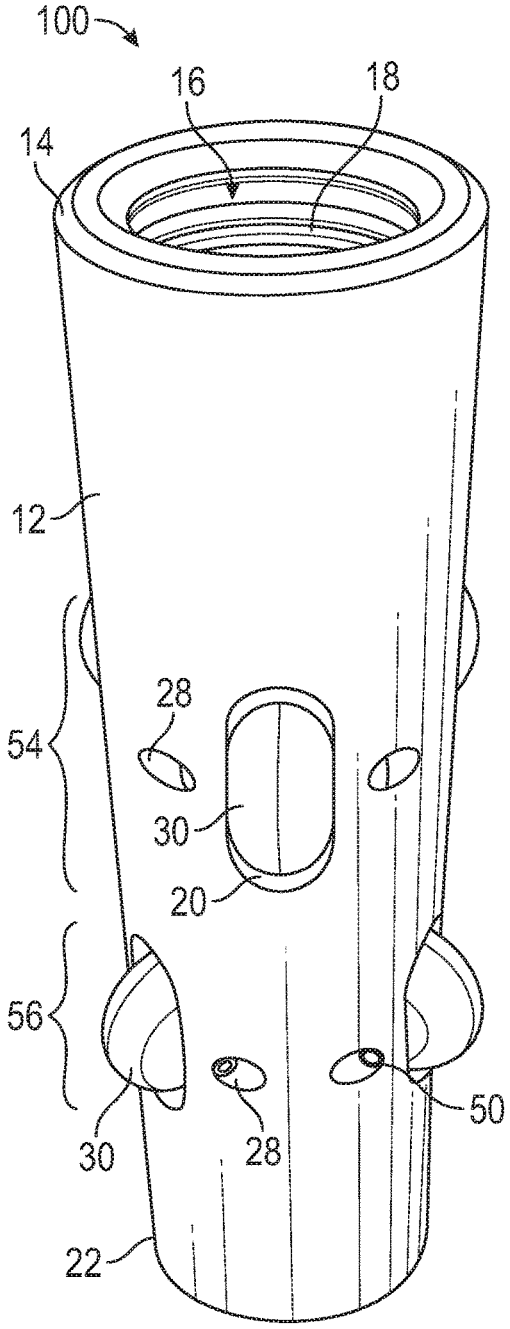
FIG. 9 is a side view of another embodiment of a roller coupling apparatus in accordance with one or more aspects of the present invention.
Figure 10:
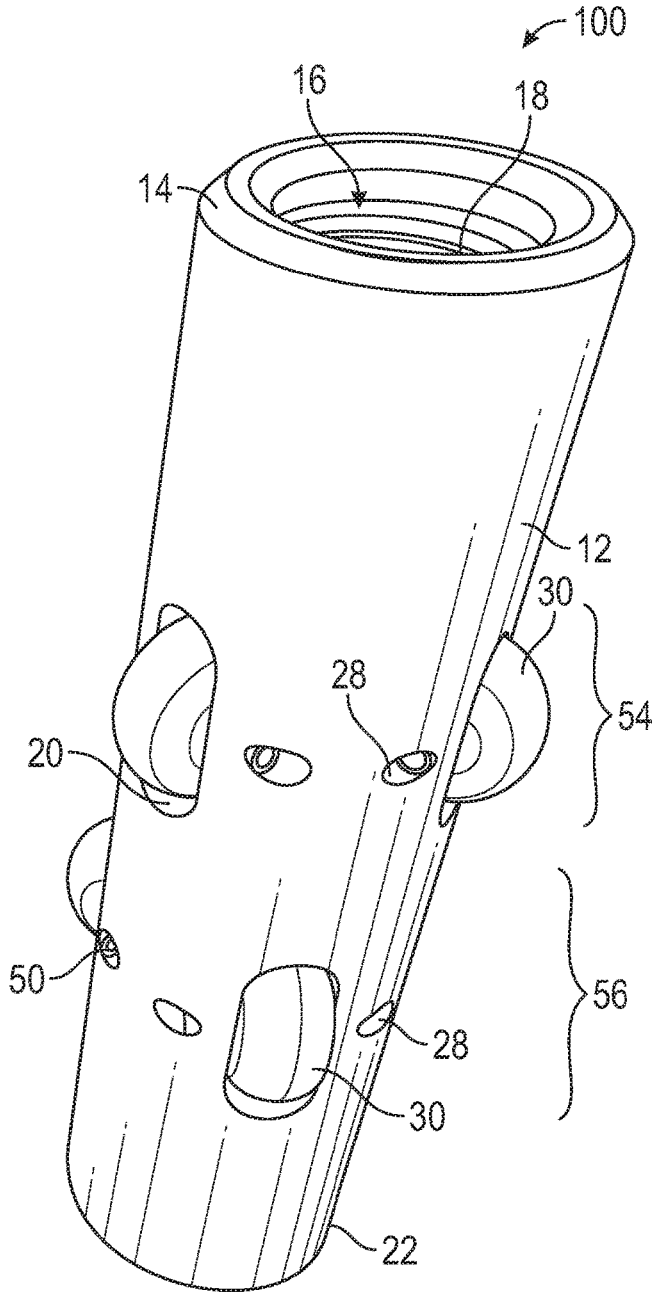
FIG. 10 is another side view of the roller coupling apparatus of FIG. 9.

Referring now to FIGS. 9-10, reference number 100 refers generally to another embodiment of the roller coupling apparatus of the present invention. The roller coupling apparatus 100 is similar to the roller coupling apparatus 10, but includes a body 12 of a length longer than the roller coupling apparatus 10 in order to accommodate an additional set of wheels 30. For this reason, the same reference numbers used in describing the features of the roller coupling apparatus 10 will be used when describing the identical features of the roller coupling apparatus 100.

In this embodiment, the body 12 includes six wheel wells 20, corresponding to six wheels 30 (see FIGS. 9-10, which show opposing sides of the roller coupling apparatus 100). However, it should be understood that more or less than six wheel wells 20, corresponding to more or less than six wheels 30, may be provided as desired. As can be seen from a review of FIGS. 9-10, a first set of three wheel wells 20 is provided proximate the north end 14 of the body 12, while a second set of three wheel wells 20 is provided proximate the south end 22 of the body 12. In one embodiment, the body 12 of the roller coupling apparatus 100 can be approximately seven inches in length. This longer length, compared to the length of the roller coupling apparatus 10 (which, as described above, is approximately five inches in length), is configured to accommodate the second set of three wheel wells 20 and wheels 30. However, it should be understood that the length of the body 12 may deviate from this dimension, as desired. For example, the roller coupling apparatus 100 could have a length longer than twenty-four inches, in order to accommodate yet additional sets of wheels 30. It should be noted that for each additional set of wheels incorporated into the roller coupling apparatus 100, approximately two inches are added to the length of the body 12 in order to accommodate the additional wheel set(s). For example, a roller coupling apparatus 100 with three sets of wheels would have a body 12 length of approximately nine inches, a roller coupling apparatus 100 with four sets of wheels would have a body 12 length of approximately eleven inches, and so on.

As seen from a review of FIGS. 9-10, in this embodiment, the roller coupling apparatus 100 utilizes two sets of three wheels 30 each, including three wheels 30 positioned in a northern wheel region 54, proximate the northern end 14 of the body 12, and three wheels 30 positioned in a southern wheel region 56, proximate the southern end 22 of the body 12, for a total of six wheels 30. The wheels 30 of the northern wheel region 54 are positioned in a first horizontal plane. Further, the wheels 30 of the northern wheel region 54 are positioned radially around the body 12 and are spaced-apart equidistantly from each other. In this embodiment, the wheels 30 of the northern wheel region 54 are spaced 120 degrees apart. Similarly, the wheels 30 of the southern wheel region 56 are positioned in a second horizontal plane that is located southward of the first horizontal plane. Further, the wheels 30 of the southern wheel region 56 are positioned radially around the body 12 and are spaced-apart equidistantly from each other. In this embodiment, the wheels 30 of the southern wheel region 56 are spaced 120 degrees apart. As seen from a review of FIGS. 9-10, the wheels 30 of the northern wheel region 54 are staggered relative to the wheels 30 of the southern wheel region 56, and vice versa, such that each wheel 30 of the northern wheel region 54 is positioned diagonally from each wheel 30 of the southern wheel region 56, and vice versa. As with the roller coupling apparatus 10, the configuration of the wheels 30 in the roller coupling apparatus 100 spreads the rod load more uniformly within the interior diameter of the tubing. In this regard, this configuration allows for 360-degree load weight carrying of the rod to transfer to the wheels 30 which roll inside the tubing, thereby eliminating the surface-to-surface wear of the sucker rod coupling and tubing that can occur during pumping operations, especially in deviated areas of the wellbore. As with the roller coupling apparatus 10, while in this embodiment the wheels 30 are shown positioned inline vertically on the body 12, it should be understood that the wheels 30 can be positioned at various degrees from vertical on the body 12. Such a configuration allows for slight rod rotation during pumping operations which, in turn, allows for more even wear, helping to eliminate premature pumping operation failures related to rod and tubing wear issues.

While non-grooved wheels 30 are shown in the embodiment in FIGS. 9-10, it should be understood that the wheels 30 of the roller coupling apparatus 100 may include wear grooves 35, as shown in FIG. 5B and as discussed above.

As described herein, each roller coupling apparatus 10 and 100 is configured to be coupled at its north end 14 to the south end of a rod, and at its south end 22 to the north end of another rod or to a sinker bar, thereby connecting the two rods together, or connecting a rod and a sinker bar together, to form an assembly. Multiple roller coupling apparatuses 10 and 100 may be utilized to connect multiple rods together, thereby forming a rod string of various lengths, as may be needed depending on the depth of the well and length of the wellbore in which the roller coupling apparatuses 10 and 100 are employed.

The roller coupling apparatus 10 can be installed in the same manner as a conventional rod coupling. In this regard, the roller coupling apparatus 10 can be installed with hydraulic power tongs on the pulling unit. Such tongs can be set so that an equal amount of torque is applied to each roller coupling apparatus 10 utilized in a given pumping operation, which can include multiple roller coupling apparatuses 10 as may be needed. This method of installation is economical, efficient, and provides torque consistency among the rod couplings. Compared to manual installation, this method of installation is faster in that it can require a few seconds to install rod couplings with hydraulic power tongs, as opposed to the minutes that may be required for manual installation.

Unlike the roller coupling apparatus 10, the roller coupling apparatus 100, with its multiple sets of wheels 30, is not suited for installation with hydraulic power tongs on the pulling unit, due to its longer body length. Instead, the roller coupling apparatus 100 can be installed manually with hand wrenches or other hand tools.

In operation, the roller coupling apparatus 10 or 100, being part of the rod string, will move up with the upstroke of the pumping unit and down with the downstroke of the pumping unit. As the roller coupling apparatus 10 or 100 moves within in the wellbore, wheels 30 make contact with and roll along the interior diameter surface of the tubing. This prevents the body 12 exterior from contacting the tubing interior, preventing surface-to-surface wear of the body 12 exterior and tubing interior, including in deviated areas of the wellbore. In turn, with the wheels 30 contacting the tubing, this helps to keep the rods from contacting the tubing. This prolongs the life of the rod assembly and tubing.

The roller coupling apparatus 10 or 100 that includes one or more wear grooves 35 on wheels 30 provides further advantages. In this regard, wear grooves 35 allow the operator to determine the wear undergone by the wheels 30 and provide an indication of when the roller coupling apparatus(es) 10 or 100 should be repaired or replaced. The operator can inspect the wheels 30 for wear when the well experiences down-time and the downhole pumping system components are retrieved for repair. This will enable the operator to determine the location of the most severe wear areas in the wellbore, by reviewing the wear patterns on the wheels 30 including where the grooves 35 have become worn. The operator can then make an informed decision, based on quantitative data, to place additional roller coupling apparatuses 10 or 100 in the severe wear areas, by replacing single sucker rods with multiple, shorter, pony rods, which would allow for more roller coupling apparatuses 10 or 100 to be installed in wellbore locations experiencing severe wear. Such wear may occur due to such reasons as rod loading in deviated areas of the wellbore or rod buckling due to fluid pounding caused by the pump barrel not completely filling with fluid in between pump strokes. This causes the rods to buckle in the tubing, particularly when the traveling valve passes through an empty space in the barrel and then slams into the fluid area. This results in a large shock throughout the rod assembly, causing damage to the rods and tubing. Utilizing the roller coupling apparatus 10 or 100 in the rod assembly lessens the damage to the rod assembly and tubing.

The foregoing description is illustrative of particular embodiments of the invention, but is not meant to be a limitation upon the practice thereof. While embodiments of the disclosure have been described in terms of various specific embodiments, those skilled in the art will recognize that the embodiments of the disclosure may be practiced with modifications without departing from the spirit and scope of the invention.

What is claimed is:

1. A roller coupling apparatus comprising, in combination:

a body comprising:

a threaded upper end;

a threaded lower end; and a plurality of wheel wells positioned between the upper end and the lower end; and a plurality of wheels rotatably coupled to the body, wherein each wheel of the plurality of wheels comprises:

a convex outer wall having only one circumferential wear groove, the circumferential wear groove centrally positioned on the outer wall;

a pair of sidewall having a plurality of wear grooves positioned on the sidewalls; and an opening wall defining a central opening, wherein the opening wall is configured to receive an insert;

wherein each wheel well of the plurality of wheel wells is configured to receive one of the plurality of wheels;

wherein each wheel well of the plurality of wheel wells is semi-circularly shaped and comprises a concave wall configured to correspond to the convex outer wall of each wheel;

wherein the plurality of wheels are positioned radially around the body;

wherein the plurality of wheels are horizontally coplanar with each other; and wherein the plurality of wheels are spaced-apart equidistantly from each other.

2. The roller coupling apparatus of claim 1 further comprising:

a plurality of aligned pairs of openings in the body;

a plurality of inserts, each insert having an opening configured to receive an axle, and wherein each insert is configured to be positioned in an opening in one of the plurality of wheels;

a plurality of axles, wherein each axle is configured to be positioned through one of the plurality of aligned pairs of openings in the body and in one of the plurality of inserts.

3. The roller coupling apparatus of claim 2 wherein each axle of the plurality of axles includes ridges on an outer surface thereof.

4. The roller coupling apparatus of claim 1 wherein the wear grooves on the sidewalls are concentric and spaced apart equidistantly from each other.

5. The roller coupling apparatus of claim 1 wherein the plurality of wheels comprises three wheels.

6. The roller coupling apparatus of claim 1 wherein the plurality of wheels comprises a first plurality of wheels and the plurality of wheel wells comprises a first plurality of wheel wells, the roller coupling apparatus further comprising:

a second plurality of wheel wells positioned between the upper end and the lower end of the body;

a second plurality of wheels rotatably coupled to the body, wherein each wheel of the second plurality of wheels comprises:

a convex outer wall having only one circumferential wear groove, the circumferential wear groove centrally positioned on the outer wall;

a pair of sidewalls having a plurality of wear grooves positioned on the sidewalls; and an opening wall defining a central opening, wherein the opening wall is configured to receive an insert;

wherein each wheel well of the second plurality of wheel wells is configured to receive one of the second plurality of wheels;

wherein each wheel well of the second plurality of wheel wells is semi-circularly shaped and comprises a concave wall configured to correspond to the convex outer wall of each wheel of the second plurality of wheels;

wherein the second plurality of wheels are positioned radially around the body;

wherein the second plurality of wheels are horizontally coplanar with each other;

wherein the second plurality of wheels are spaced-apart equidistantly from each other; and wherein the second plurality of wheels comprises three wheels.

7. The roller coupling apparatus of claim 6 wherein the first plurality of wheels are positioned in an upper wheel region proximate the upper end of the body and the second plurality of wheels are positioned in a lower wheel region proximate the lower end of the body.

8. A roller coupling apparatus comprising, in combination:

a body comprising:

a threaded upper end;

a threaded lower end;

a plurality of wheel wells positioned between the upper end and the lower end; and a plurality of aligned pairs of openings;

a plurality of wheels rotatably coupled to the body, wherein each wheel of the plurality of wheels comprises:

a convex outer wall having only one circumferential wear groove, the circumferential wear groove centrally positioned on the outer wall;

a pair of sidewalls having a plurality of wear grooves positioned on the sidewalls; and an opening wall defining a central opening, wherein the opening wall is configured to receive an insert;

a plurality of inserts, each insert having an opening configured to receive an axle, and wherein each insert is configured to be positioned in an opening in one of the plurality of wheels;

a plurality of axles, wherein each axle is configured to be positioned through one of the plurality of aligned pairs of openings in the body and in one of the plurality of inserts, and wherein each axle of the plurality of axles includes longitudinal ridges on an outer surface thereof;

wherein each wheel well of the plurality of wheel wells is configured to receive one of the plurality of wheels;

wherein each wheel well of the plurality of wheel wells is semi-circularly shaped and comprises a concave wall configured to correspond to the convex outer wall of each wheel;

wherein the plurality of wheels are positioned radially around the body;

wherein the plurality of wheels are horizontally coplanar with each other; and wherein the plurality of wheels are spaced-apart equidistantly from each other.

9. The roller coupling apparatus of claim 8 wherein the wear grooves on the sidewalls are concentric and spaced apart equidistantly from each other.

10. The roller coupling apparatus of claim 8 wherein the plurality of wheels comprises three wheels.

11. The roller coupling apparatus of claim 8 wherein the plurality of wheels comprises a first plurality of wheels and the plurality of wheel wells comprises a first plurality of wheel wells, the roller coupling apparatus further comprising:

a second plurality of wheel wells positioned between the upper end and the lower end of the body;

a second plurality of wheels rotatably coupled to the body, wherein each wheel of the second plurality of wheels comprises:

a convex outer wall having only one circumferential wear groove, the circumferential wear groove centrally positioned on the outer wall;

a pair of sidewalls having a plurality of wear grooves positioned on the sidewalls; and an opening wall defining a central opening, wherein the opening wall is configured to receive an insert;

wherein each wheel well of the second plurality of wheel wells is configured to receive one of the second plurality of wheels;

wherein each wheel well of the second plurality of wheel wells is semi-circularly shaped and comprises a concave wall configured to correspond to the convex outer wall of each wheel of the second plurality of wheels;

wherein the second plurality of wheels are positioned radially around the body;

wherein the second plurality of wheels are horizontally coplanar with each other;

wherein the second plurality of wheels are spaced-apart equidistantly from each other; and wherein the second plurality of wheels comprises three wheels.

12. The roller coupling apparatus of claim 11 wherein the first plurality of wheels are positioned in an upper wheel region proximate the upper end of the body and the second plurality of wheels are positioned in a lower wheel region proximate the lower end of the body.

13. A method for protecting pumping system components from wear during pumping operations, comprising the steps of:

providing a pumping unit;

providing a roller coupling apparatus comprising, in combination:

a body comprising:

a threaded upper end; and a threaded lower end; and a plurality of wheel wells positioned between the upper end and the lower end; and a plurality of wheels rotatably coupled to the body, wherein each wheel of the plurality of wheels comprises:

a convex outer wall having only one circumferential wear groove, the circumferential wear groove centrally positioned on the outer wall;

a pair of sidewalls having a plurality of wear grooves positioned on the sidewalls; and an opening wall defining a central opening, wherein the opening wall is configured to receive an insert;

wherein each wheel well of the plurality of wheel wells is configured to receive one of the plurality of wheels;

wherein each wheel well of the plurality of wheel wells is semi-circularly shaped and comprises a concave wall configured to correspond to the convex outer wall of each wheel;

wherein the plurality of wheels are positioned radially around the body;

wherein the plurality of wheels are horizontally coplanar with each other; and wherein the plurality of wheels are spaced-apart equidistantly from each other;

providing a first threaded component;

providing a second threaded component;

securing together the first and second threaded components by threadably coupling the upper end of the roller coupling apparatus to a lower end of the first threaded component and threadably coupling the lower end of the roller coupling apparatus to an upper end of the second threaded component to form an assembly;

positioning the assembly within tubing of a wellbore;

causing the assembly to move up with an upstroke of the pumping unit and down with a downstroke of the pumping unit; and during the movement with the upstroke and the downstroke, causing the wheels of the roller coupling apparatus to contact and roll along an interior diameter surface of the tubing.

14. The method of claim 13 wherein:

the first threaded component is one of a sucker rod and pony rod; and the second threaded component is one of a sucker rod, pony rod, and sinker bar.

* * * * *